US009248363B1

(12) United States Patent
Christianson

(10) Patent No.: US 9,248,363 B1
(45) Date of Patent: Feb. 2, 2016

(54) MINIATURIZED HOCKEY GAME

(71) Applicant: Jame' Thomas Christianson, Eagan, MN (US)

(72) Inventor: Jame' Thomas Christianson, Eagan, MN (US)

( * ) Notice: Subject to any disclaimer, the term of this patent is extended or adjusted under 35 U.S.C. 154(b) by 29 days.

(21) Appl. No.: 13/871,606

(22) Filed: Apr. 26, 2013

(51) Int. Cl.

| | |
|---|---|
| ***A63F 7/06*** | (2006.01) |
| ***A63F 7/07*** | (2006.01) |
| ***A63F 7/00*** | (2006.01) |
| ***A63B 71/04*** | (2006.01) |

(52) U.S. Cl.
CPC . *A63B 71/04* (2013.01); *A63F 7/00* (2013.01); *A63F 7/06* (2013.01); *A63F 7/0632* (2013.01)

(58) Field of Classification Search
CPC ..... A63B 71/04; A63B 67/04; A63B 2243/0041; A63B 7/00; A63F 7/06; A63F 7/0636; A63F 7/0632; A63F 2007/3655; A63F 2007/3015
USPC ..... 273/108, 108.1, 108.5, 126 R, 126 A, 273/129 R, 129 K, 129 L, 287; 473/116, 162, 473/115, 117; D21/318, 397
See application file for complete search history.

(56) References Cited

U.S. PATENT DOCUMENTS

| | | | | | |
|---|---|---|---|---|---|
| 362,898 | A | * | 5/1887 | Muringer | 273/108 |
| 592,465 | A | * | 10/1897 | Clark | 273/108.32 |
| 797,675 | A | * | 8/1905 | Fletcher | 273/126 R |
| 1,144,112 | A | * | 6/1915 | Denny | 273/108.57 |
| 1,512,722 | A | * | 10/1924 | Szekely | 273/108 |
| 1,593,421 | A | * | 7/1926 | Blum | 273/108.5 |
| D167,066 | S | * | 6/1952 | Bronson | D21/312 |
| 3,591,176 | A | * | 7/1971 | Roth | 473/3 |
| 4,018,443 | A | * | 4/1977 | Bird | 473/471 |
| 4,560,163 | A | * | 12/1985 | Erickson | 273/108.1 |
| 5,161,801 | A | | 11/1992 | Kazuk | |
| 5,417,421 | A | * | 5/1995 | Bagley | 273/108.5 |
| 5,785,615 | A | * | 7/1998 | Kosmalski | 473/471 |
| 5,882,007 | A | * | 3/1999 | Gay | 273/108.1 |
| D408,459 | S | * | 4/1999 | Schwarz | D21/318 |
| D425,136 | S | * | 5/2000 | Martin, Sr. | D21/318 |
| 6,126,561 | A | | 10/2000 | von der Mark | |
| 6,409,169 | B1 | | 6/2002 | Sutter | |
| 6,457,711 | B1 | * | 10/2002 | Baulesh | 273/108.1 |
| 6,764,074 | B2 | * | 7/2004 | Bangerter | 273/108.1 |
| 8,267,804 | B1 | | 9/2012 | Tsai | |
| 2002/0098896 | A1 | * | 7/2002 | Rieber et al. | 473/10 |
| 2003/0047868 | A1 | * | 3/2003 | Jenkins | 273/108.57 |
| 2003/0146570 | A1 | * | 8/2003 | Brody | 273/108.1 |
| 2004/0009821 | A1 | | 1/2004 | Samborski | |
| 2008/0220913 | A1 | | 9/2008 | Cosenza | |

OTHER PUBLICATIONS

Competitive Edge Products, Inc. SO Classic Sport X0625 8 Traditional Table Hockey. http://www.competetitiveedgeporducts.com/detail.aspx?ID=699.

* cited by examiner

*Primary Examiner* — Sebastiano Passaniti
(74) *Attorney, Agent, or Firm* — Montgomery Patent & Design; Robert C. Montgomery

(57) ABSTRACT

A miniaturized hockey game having a wall structure and a floor structure configured to represent a hockey rink along with hockey sticks and a puck. The wall structure is removable from the floor structure. To that end the floor structure include recessed grooves for receiving and supporting the wall structure. A faceoff platform is on top of a dividing wall of the wall structure. The wall structure includes scoring apertures for simulating nets and center apertures for providing obstacles to increase the difficulty of play. In use players stand along the perimeter of the hockey game and manipulate a puck using their hockey sticks to cause the puck to pass through the scoring apertures to score points.

16 Claims, 4 Drawing Sheets

MINIATURIZED HOCKEY GAME

RELATED APPLICATIONS

There are no current co-pending applications.

FIELD OF THE INVENTION

The presently disclosed subject matter is directed toward multi-player games. More particularly it is directed to a miniaturized, multiple player hockey game suitable for indoor and outdoor use.

BACKGROUND OF THE INVENTION

Hockey is one (1) of the fastest growing sports in the United States. While traditionally hockey was a winter sport only played in colder regions, one can now find hockey leagues in the spring, summer, and fall all across the United States. Fast, exciting, and fun, hockey can be, and is, played by the very young to the very old. From junior leagues to international teams, millions of Americans simply love hockey.

Hockey is a game usually associated with ice. Unfortunately this greatly reduces the possibility for many people to enjoy hockey. In addition to those without access to a hockey rink there are those who are out of shape, perhaps elderly or disabled, who have a different skill level than other players, or who for a variety of other reasons are not able to enjoy the physical aspects of hockey as played on ice.

Accordingly, there exists a need for a means by which the fun, competition, and thrills associated with the game of hockey can be enjoyed by all, regardless of access to a hockey rink. Beneficially such a means would enable multiple people to compete in a challenging environment. Preferably such a means would be easy to use, low in cost, simulate hockey play, could be used both indoors and outdoors, and would not require too much space.

SUMMARY OF THE INVENTION

The principles of the present invention provide for a multi-player hockey game that seeks to make the fun, competition, and thrills associated with the game of hockey accessible to those without access to a hockey rink. Beneficially the multi-player hockey game enables multiple people to compete in simulated hockey. The multi-player hockey game can be easily used indoors or out in a limited playing area and can be made available at low cost.

A hockey game that is in accord with the present invention includes a floor structure having a flat playing surface with a perimeter and a wall structure extending along that perimeter. The wall structure includes a first long wall, a first end wall, a second long wall, a second end wall, and a dividing wall that extends between the middle of the first long wall and the middle of the second long wall. The first long wall, first end wall, second long wall, and second end wall are rounded at their corners. The hockey game further includes a faceoff platform on top of the dividing wall. The first end wall has a half-oval-shaped first scoring aperture, the second end wall has a half-oval-shaped second scoring aperture; and the dividing wall includes two half-oval-shaped center apertures.

Beneficially the two (2) center apertures have the same dimensions as the first scoring aperture, while the second scoring aperture has the same dimensions as the first scoring aperture.

In practice the playing surface is comprised of a low-friction smooth plastic, faceoff platform is centered on the dividing wall and the wall structure is approximately six inches (6 in.) high. The hockey game may further include puck and at least two (2) hockey sticks. Beneficially the playing surface is approximately eight feet (8 ft.) long and three feet (3 ft.) wide. Also beneficially the hockey game includes indicia.

Preferably the wall structure is removable from the floor structure. The floor structure may include a recessed channel-shaped first wall slot and a recessed channel-shaped second wall slot and the first wall slot may receive the bottom edge of the first long wall while the second end wall receives the bottom edge of the second long wall. The first wall slot and the second wall slot may receive different ends of the first end wall. The floor structure may also include a recessed channel-shaped third wall slot, a recessed channel-shaped fourth wall slot, and a recessed channel-shaped fifth wall slot and the third wall slot, floor structure fourth wall slot, and floor structure fifth wall slot may receive bottom edges of floor structure dividing wall.

Another hockey game that is in accord with the present invention includes a floor structure having a flat playing surface with an outer perimeter. The floor structure has a recessed channel-shaped first wall slot disposed around part of the perimeter, a recessed channel-shaped second wall slot disposed around another part of the perimeter, a recessed channel-shaped third wall slot extending inward from the middle of the first wall slot, a recessed channel-shaped fourth wall slot extending inward from the middle of the second wall slot, and a recessed channel-shaped fifth wall slot disposed in line between the third wall slot and the fourth wall slot. The hockey game further includes a wall structure having a first long wall and a first end wall with bottom edges that are inserted into the first wall slot, a second long wall and a second end wall with bottom edges inserted into the second wall slot, and a dividing wall having bottom edges inserted into the third wall slot, into the fourth wall slot, and the fifth wall slot. In addition there is a faceoff platform on top of the dividing wall. The first long wall, the first end wall, the second long wall, and the second end wall have rounded corners. In addition, the first end wall has a half-oval-shaped first scoring aperture, the second end wall has a half-oval-shaped second scoring aperture, and the dividing wall includes two (2) half-oval-shaped center apertures.

In practice the two (2) center apertures have the same dimensions as the first scoring aperture, and the second scoring aperture has the same dimensions as the first scoring aperture. In addition, the playing surface is beneficially comprised of a low-friction smooth plastic and the faceoff platform is beneficially centered on the dividing wall. The hockey game may further include a puck and at least two (2) hockey sticks.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
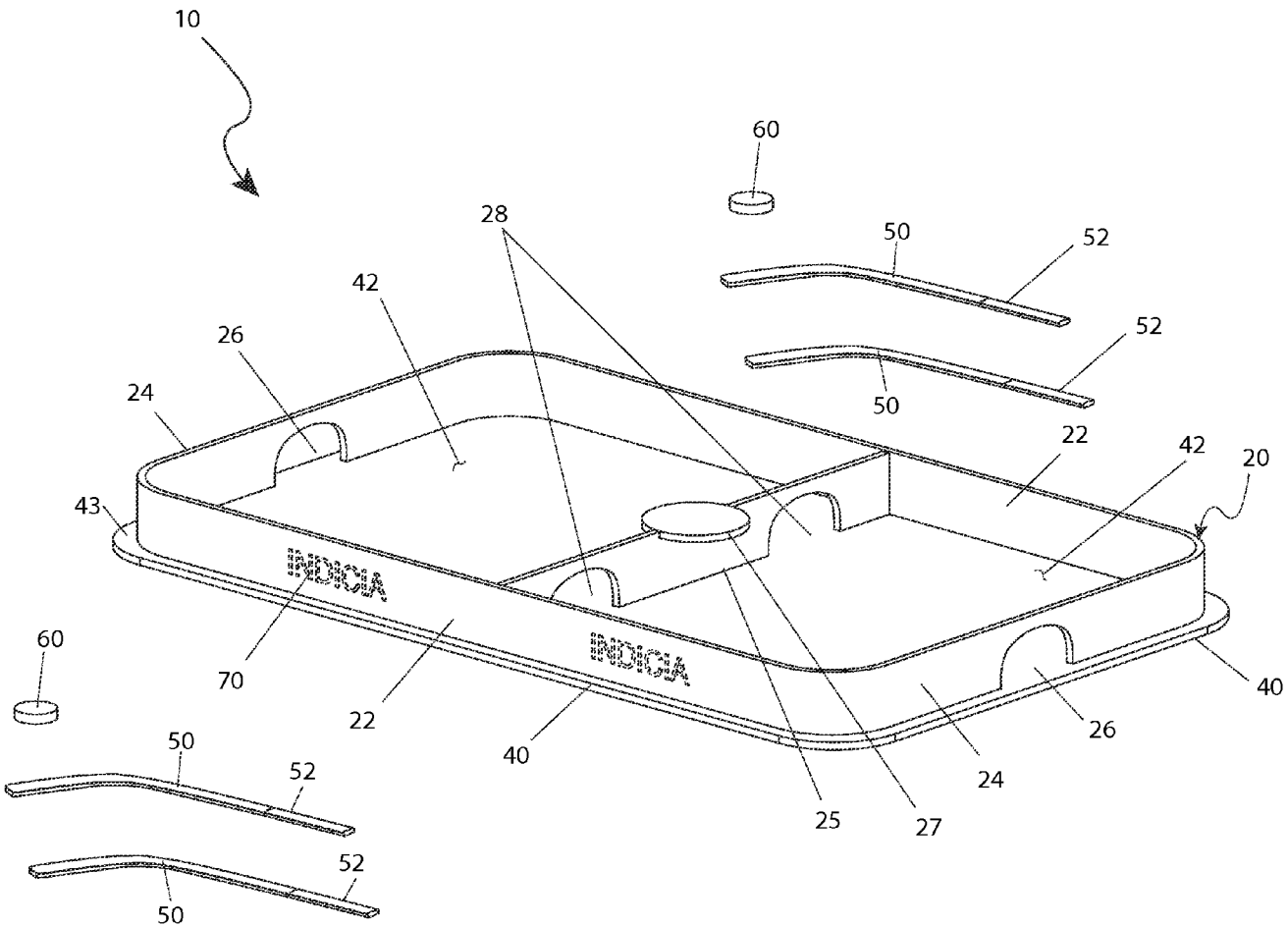
FIG. 1 is a perspective view of a hockey game 10 that is in accord with a preferred embodiment of the present invention.

10 hockey game
20 wall structure
22 long perimeter wall
24 end perimeter wall
25 divider wall
26 scoring aperture
27 faceoff platform
28 center aperture
40 lower floor structure
42 playing surface
43 horizontal edge
44*a* first side wall slot
44*b* second side wall slot
44*c* third wall slot
44*d* fourth wall slot
44*e* fifth wall slot
50 hockey stick
52 grip
60 puck
70 indicia
100 player

DETAILED DESCRIPTION OF THE PREFERRED EMBODIMENT

The best mode for carrying out the invention is presented in terms of its preferred embodiment, herein depicted within FIGS. 1 through 3*c*. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a hockey game that includes a miniature hockey rink and a predetermined method of play. While described herein as being played indoors, that is for convenience of explanation only. The hockey game 10 is well suited for both indoor and outdoor play.

FIG. 1 presents a perspective view of a hockey game 10 that is in accord with a preferred embodiment of the present invention. The hockey game 10 includes a lower floor structure 40 having a flat plastic playing surface 42 that is approximately eight feet (8 ft.) long and three feet (3 ft.) wide. Those dimensions are very well suited for the majority of players and are usually highly beneficial and represent a scaled down hockey rink. However other dimensions maybe used with younger players or players with disabilities. As shown, the hockey game 10 includes the lower floor structure 40 and an upper wall structure 20 that is comprised of long perimeter walls 22, end perimeter walls 24, and a bisecting dividing wall 25. The lower floor structure 40 and the upper wall structure 20 resemble a miniature hockey rink.

Figure 2:
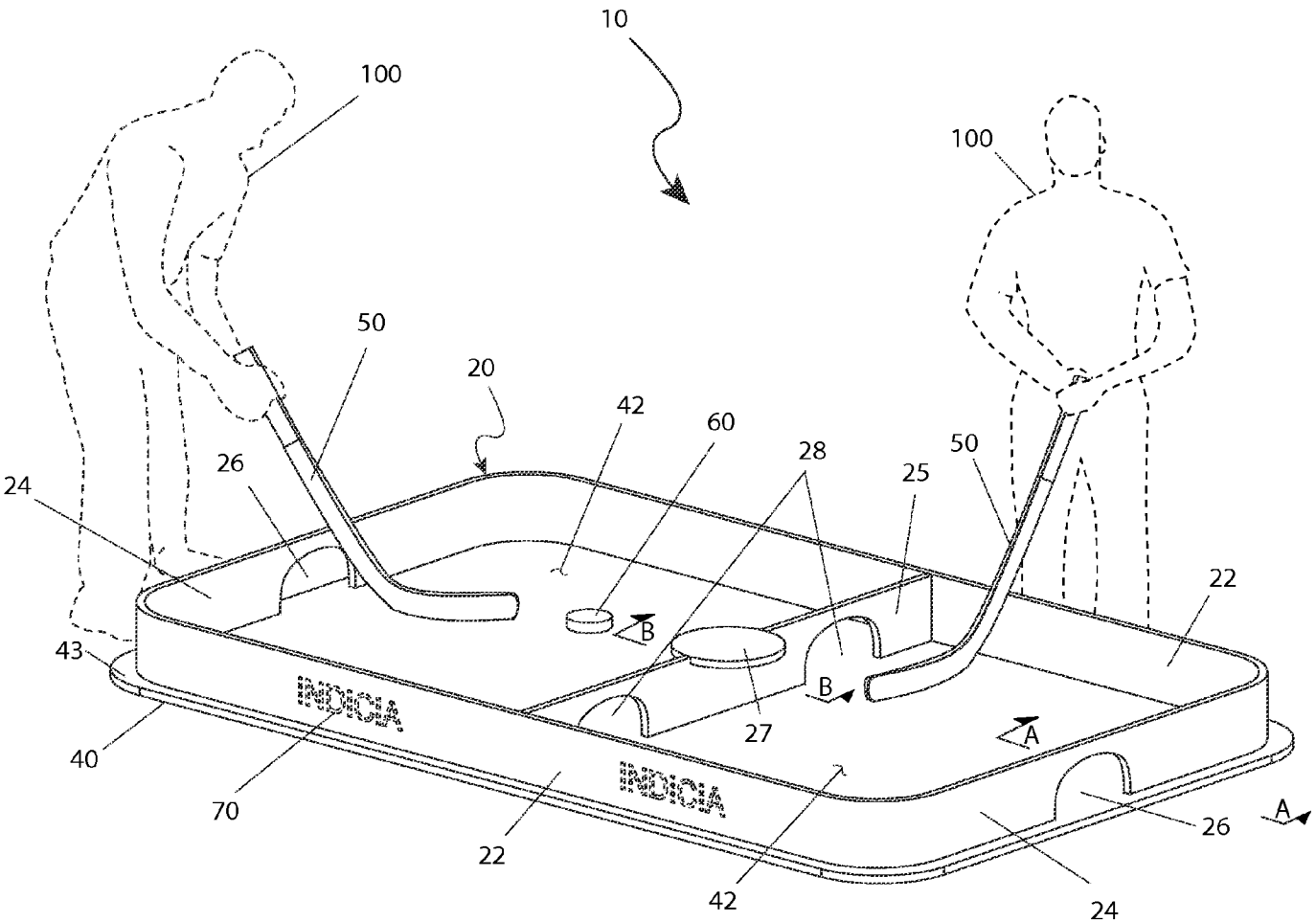
FIG. 2 is an environmental view of an in-use hockey game.
Figure 3A:
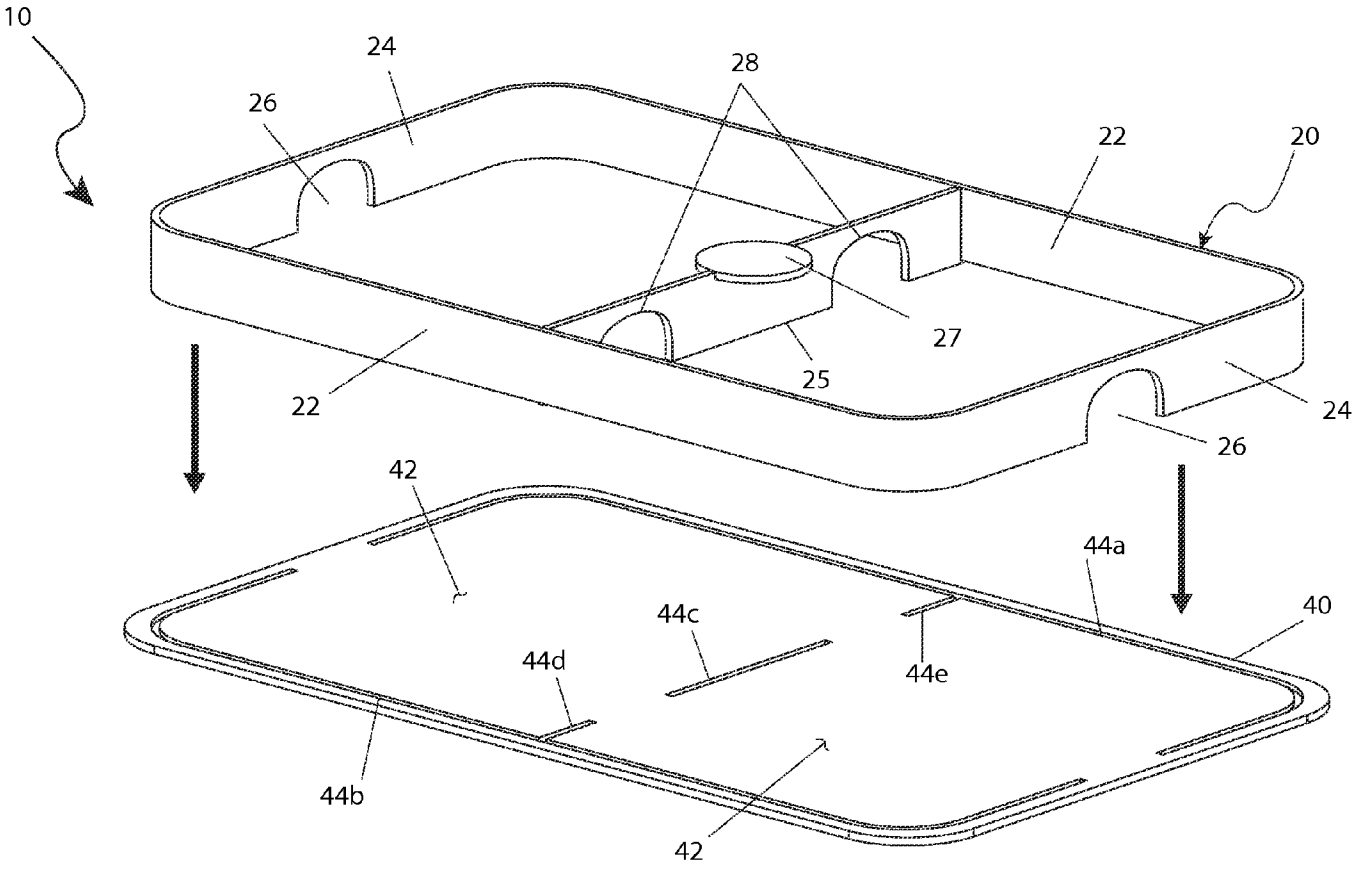
FIG. 3*a* is an exploded view of the hockey game 10 shown in FIGS. 1 and 2.
Figure 3B:
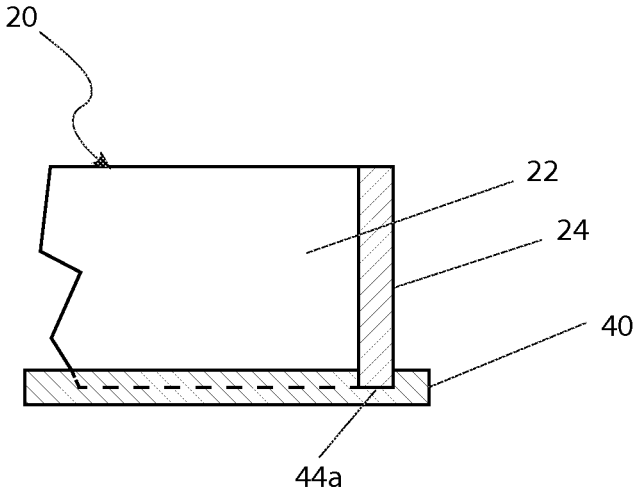
FIG. 3*b* is a section view of the hockey game 10 taken along section line A-A of FIG. 2; and, FIG. 3*c* is a section view of the hockey game 10 taken along section line B-B of FIG. 2.
Figure 3C:
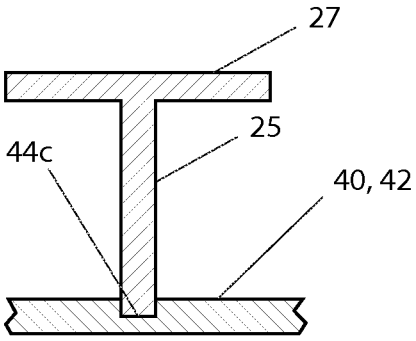

Referring now to FIGS. 1 and 2, the hockey game 10 also includes a puck 60 and sufficient hockey sticks 50 to allow up to four (4) players to play the hockey game 10. The long perimeter walls 22, the end perimeter walls 24, and the dividing wall 25 are beneficially about six inches (6 in.) high. The long perimeter walls 22 and the end perimeter walls 24 are rounded at the corners while the bisecting dividing wall 25 extends between the centers of the long perimeter walls 22.

Still referring to FIGS. 1 and 2, the end perimeter walls 24 each have a half-oval-shaped scoring aperture 26 that is approximately three to four inches (3-4 in.) wide. Each scoring aperture 26 represents an opponent's goal. Centered on top of the dividing wall 25 is a faceoff platform 27. About half way between the center of the faceoff platform 27 and each long perimeter walls 22 is a center aperture 28. Thus there are two center apertures. During play a player 100 (see FIG. 2) attempts to manipulate a puck 60 using a hockey stick 50 through one of the center apertures 28 and then into an opponent's scoring aperture 26. Each center aperture 28 is shaped similarly to the scoring apertures 26.

The outer surfaces of the long perimeter walls 22 and the end perimeter walls 24, as well as the playing surface 42 may include various indicia 70 such as scripts or logos or images to customize and personalize the hockey game 10. For example, the indicia 70 may include sports names/logos, personal names, symbols, lines, pictures, and the like, in various colors and patterns. Such indicia 70 may seek to align the hockey game 10 with professional or college teams, their colors, or sponsors.

The lower floor structure 40 is beneficially a flat plastic panel having a perimeter shape that is similar to but slightly larger than the perimeter formed by the long perimeter walls 22 and the end perimeter walls 24. The extra dimensions of the lower floor structure 40 provide a horizontal edge 43. Significantly, the lower floor structure 40 may be removed, if desired, to enable use of the upper wall structure 20 on an existing surface. The lower floor structure 40 includes the playing surface 42, which is beneficially a low-friction surface that enables smooth sliding of a puck 60 during play.

Referring now to FIGS. 1, 2, 3*a*, and 3*b*, the lower floor structure 40 includes a recessed channel-shaped first wall slot 44*a* and recessed channel-shaped second wall slot 44*b* which are disposed around opposing perimeter edges of the lower floor structure 40. The first wall slot 44*a* and the second wall slot 44*b* are configured to receive the bottom edges of the aforementioned long perimeter walls 22 and the end perimeter walls 24. The first wall slot 44*a* and the second wall slot 44*b* are separated at the ends by the positions of the scoring apertures 26. The first wall slot 44*a* and the second wall slot 44*b* are envisioned as being approximately one-quarter of an inch (¼ in.) deep and sized to receive, anchor and stabilize the long perimeter walls 22 and the end perimeter walls 24.

Referring now to FIGS. 1, 2, 3*a*, and 3*c*, the lower floor structure 40 also includes a recessed third wall slot 44*c*, a recessed fourth wall slot 44*d*, and a recessed fifth wall slot 44*e*. The third wall slot 44*c*, fourth wall slot 44*d*, and fifth wall slot 44*e* are disposed along a line that bi-sects the lower floor structure 40 between the long perimeter walls 22. The fourth wall slot 44*d* extends perpendicularly inward from the second wall slot 44*b*, while the fifth wall slot 44*e* extends perpendicularly inward from the first wall slot 44*a*. The third wall slot 44*c*, fourth wall slot 44*d*, and fifth wall slot 44*e* are configured to receive the bottom edges of the aforementioned dividing wall 25. Like the first wall slot 44*a* and second wall slot 44*b*, the third wall slot 44*c*, fourth wall slot 44*d*, and fifth wall slot 44*e* are envisioned as being approximately one-quarter of an inch (¼ in.) deep and sized to receive, anchor and stabilize the dividing wall 25.

Referring now to FIGS. 1 and 2, the hockey game 10 preferably comes with at least two (2) plastic pucks 60 and at least four (4) hockey sticks 50. This enables up to four (4) players to play the hockey game 10. However, the hockey game 10 may include more hockey sticks 50 and pucks 60 as required to enable more players 100 to play. Each hockey stick 50 includes a sprayed on or adhesively bonded grip 52 comprised of foam rubber or another high-friction material which is located at the end of the long leg of the hockey stick 50. The hockey game 10, as well as the hockey sticks 50 and pucks 60 are envisioned as being introduced in both full-sized and scaled-down versions based upon particular age groups of the players 100.

FIG. 2 shows the hockey game 10 in-use by two (2) players 100. However, as previously mentioned it is envisioned that sufficient equipment is available for up to four (4) players 100 to play the hockey game 10. The players 100 are envisioned as standing along the outside of the upper wall structure 20 and manipulating a puck 60 along the playing surface 42 using their hockey sticks 50. Scoring is accomplished by causing the puck 60 to pass through the scoring aperture 26 at their opponent's end wall.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the hockey game 10, it would be installed and utilized as indicated in FIG. 2.

The method of installing and utilizing the hockey game 10 may be achieved by performing the following steps: procuring a model of the hockey game 10 having a desired overall size which corresponds to an age-range of intended players 100, as well as various desired external and internal indicia 70; selecting teams of players 100; positioning up to four (4) players 100 outside the long perimeter walls 22 and the end perimeter walls 24; starting the hockey game 10 by "facing-off" the puck 60 by placing the puck 60 up the central faceoff platform 27; tapping all of the player's hockey sticks 50 a pre-determined number of times in a synchronous manner to begin play; moving the puck 60 using the hockey sticks 50 along the playing surface 42 and through one of the center apertures 28, if necessary; propelling the puck 60 through an opposing team's scoring aperture 26 to score a point; continuing to "face-off" the puck 60 and score points by repeating the above steps and following the general rules of a conventional hockey game until a team of players 100 obtains five (5) points; switching the players 100 from end-to-end of the hockey game 10; ending the hockey game 10 by continuing the playing and scoring sequence until a team of players 100 obtains a total of ten (10) points; starting another hockey game 10 by selecting different teams for subsequent play or playing additional games with the same teams as desired; and, enjoying a hockey-like game in an indoor environment afforded users of the present invention 10.

The method of utilizing the hockey game 10 in an outdoor environment may be achieved by performing the following steps: removing the upper wall structure 20 from the lower floor structure 40 and placing the upper wall structure 20 upon a suitable existing paved surface; and, playing the hockey game 10 as previously described.

The use of the hockey game 10 provides the ability for hockey lovers of all ages and physical abilities to enjoy the action of the sport, regardless of their ability to access a conventional hockey rink.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A hockey game, comprising:

a floor structure having a flat playing surface with an outer perimeter, a recessed channel-shaped first wall slot and a recessed channel-shaped second wall slot;

a removable wall structure extending along said perimeter, said wall structure including a first long wall having a first bottom edge that fits into said first wall slot, a first end wall having a first half-oval-shaped scoring aperture, a second long wall having a second bottom edge that fits into said second wall slot, a second end wall having a second half-oval-shaped scoring aperture, and a dividing wall extending between the middle of said first long wall and the middle of said second long wall and having two half-oval center apertures; wherein said first long wall, said first end wall, said second long wall, and said second end wall are rounded at their corners; and, a faceoff platform centered on top of said dividing wall;

wherein a first of said two centered apertures is located half way between said center of said dividing wall and said first long wall;

wherein a second of said two centered apertures is located half way between said center of said dividing wall and second long wall; and, wherein said wall structure and said faceoff platform can be removed from said floor structure;

wherein said recessed channel-shaped first wall slot and said recessed channel-shaped second wall slot are located inwardly of and extending substantially around said outer perimeter; said first and second walls slots being separated along said first end wall and said second end wall, respectively, by said first half-oval-shaped scoring aperture and said second half-oval-shaped scoring aperture.

2. The hockey game according to claim 1, wherein said two center apertures have the same dimensions as said first scoring aperture.

3. The hockey game according to claim 2, wherein said second scoring aperture has the same dimensions as said first scoring aperture.

4. The hockey game according to claim 1, wherein said playing surface is comprised of a low-friction smooth plastic.

5. The hockey game according to claim 1, wherein said wall structure is approximately six inches high.

6. The hockey game according to claim 1, further including a puck.

7. The hockey game according to claim 1, further including at least two hockey sticks.

8. The hockey game according to claim 1, wherein said playing surface is approximately eight feet long and three feet wide.

9. The hockey game according to claim 1, further including indicia.

10. The hockey game according to claim 1, wherein said first wall slot and said second wall slot receive different ends of said first end wall.

11. The hockey game according to claim 10, wherein said floor structure includes a recessed channel-shaped third wall slot, a recessed channel-shaped fourth wall slot, and a recessed channel-shaped fifth wall slot, wherein said third wall slot, said fourth wall slot, and said fifth wall slot receive bottom edges of said dividing wall.

12. A hockey game, comprising:

a floor structure having a flat playing surface with an outer perimeter, said floor structure having a recessed channel-shaped first wall slot disposed around part of said perimeter, a recessed channel-shaped second wall slot disposed around another part of said perimeter, a recessed channel-shaped third wall slot extending inward from the middle of said first wall slot, a recessed channel-shaped fourth wall slot extending inward from the middle of said second wall slot, and a recessed channel-shaped fifth wall slot disposed in line between said third wall slot and said fourth wall slot;

a removable wall structure having a first long wall and a first end wall with bottom edges insertable into said first wall slot, said first end wall further including a first half-oval-shaped scoring aperture, a second long wall and a second end wall with bottom edges insertable into said second wall slot, said second end wall further including a second half-oval-shaped scoring aperture, and a dividing wall having bottom edges insertable into said third wall slot, into said fourth wall slot, and into said fifth wall slot, said dividing wall further including two half-oval-shaped scoring apertures; and, a faceoff platform disposed on top of and having a center point equidistant from distal ends of said dividing wall;

wherein a first of said two half-oval-shaped scoring apertures is located half way between said center point and said first long wall;

wherein a second of said half-oval-shaped scoring apertures is located half way between said center point and second long wall;

wherein said first long wall, said first end wall, said second long wall, and said second end wall have rounded corners; and, wherein said wall structure and said faceoff platform can be removed from said floor structure; wherein said recessed channel-shaped first wall slot and said recessed channel-shaped second wall slot are located inwardly of and extending substantially around said outer perimeter; said first and second walls slots being separated along said first end wall and said second end wall, respectively, by said first half-oval-shaped scoring aperture and said second half-oval-shaped scoring aperture.

13. The hockey game according to claim 12, wherein said two center apertures have the same dimensions as said first scoring aperture.

14. The hockey game according to claim 13, wherein said second scoring aperture has the same dimensions as said first scoring aperture.

15. The hockey game according to claim 12, wherein said playing surface is comprised of a low-friction smooth plastic.

16. The hockey game according to claim 12, further including a puck and at least two hockey sticks.

* * * * *